US005835332A

United States Patent [19]

White et al.

[11] Patent Number: 5,835,332

[45] Date of Patent: Nov. 10, 1998

[54] PORTABLE PROTECTIVE GROUNDING MAT

[76] Inventors: Richard White, 10020 Fairmount Drive S.E., Calgary, Alberta, Canada, T2J 0S7; Ted Krossa, 50 - 28364 Twp Rd 384, Red Deer County, AB T4S 2B5, Canada

[21] Appl. No.: 840,934

[22] Filed: Apr. 25, 1997

[30] Foreign Application Priority Data

Jul. 26, 1996 [CA] Canada ..... 2182131

[51] Int. Cl.[6] ..... H05F 3/00

[52] U.S. Cl. ..... 361/220; 307/326; 174/5 SG; 361/212

[58] Field of Search ..... 361/212, 220, 361/215, 216; 307/326; 174/5 R, 5 SB, 5 SG

[56] References Cited

U.S. PATENT DOCUMENTS

| | | | |
|---|---|---|---|
| 993,447 | 5/1911 | Hotchkiss . | |
| 1,940,491 | 12/1933 | Freitag | 175/265 |
| 2,323,461 | 7/1943 | Donelson | 175/264 |
| 2,325,414 | 7/1943 | McChesney et al. | 361/216 |
| 2,456,373 | 12/1948 | Campaigne | 361/216 |
| 2,457,299 | 12/1948 | Blemesdefer | 175/264 |
| 3,121,825 | 2/1964 | Abegg et al. | 317/2 |
| 4,388,484 | 6/1983 | York | 174/5 R |
| 4,415,946 | 11/1983 | Pitts | 361/212 |
| 4,472,471 | 9/1984 | Klein et al. | 361/212 |
| 4,484,250 | 11/1984 | Rzepecki et al. | 361/220 |
| 4,491,894 | 1/1985 | Pitts | 361/212 |
| 4,637,575 | 1/1987 | Yenzer | 174/5 R |
| 5,491,892 | 2/1996 | Fritz et al. | 29/857 |
| 5,646,370 | 7/1997 | Perkins | 174/51 |

FOREIGN PATENT DOCUMENTS

| | | | |
|---|---|---|---|
| 24 45 737 | 4/1976 | Germany | 361/216 |

*Primary Examiner*—Fritz Fleming
*Attorney, Agent, or Firm*—Thomas E. Malyszko

[57] ABSTRACT

This invention relates to a portable grounding mat, and more particularly to a mat specifically designed to protect electrical workers by providing a zone of equi-potential. The mat comprises a flexible base to which is attached at least two conductive elements laid out in a continuous pattern.

12 Claims, 2 Drawing Sheets

PORTABLE PROTECTIVE GROUNDING MAT

BACKGROUND OF THE INVENTION

The invention is directed to a portable grounding mat and more particularly to a mat specifically designed to protect electrical workers who are in contact with the ground, by providing a zone of equi-potential.

There has long been a problem, particularly with electrical workers, in protecting these individuals from electricution or other physical damage when they are operating with live electrical equipment and apparatus, that is grounded. Indeed, there have been many fatalities over the years. One particular example, which resulted in the conception of the mat of the present invention was a case where a utility worker was killed, standing on the ground, holding a wire energized by induction.

An investigation into protection systems currently available, failed to disclose any structure that could satisfy the particular requirements of this industry. An investigation into the prior art disclosed very few patents directed in any way to a solution of this problem. For example:

U.S. Pat. No. 993,447 issued May 30, 1911 to Hotchkiss discloses an osteopath's electric operating table, used for the purpose of electrically treating patients. By electrifying the table, and subjecting the operator to the same current flow as the patient on the table, excessive currents are prevented through the body of the latter.

U.S. Pat. No. 2,323,461 issued Jul. 6, 1943 to Donelson discloses a spark-proof flooring system, which grounds static electricity. A sandwiched construction is utilized comprising a thin layer of conductive material, and conductive studs imbedded to extend through a rubber or asphalt flooring to come into contact with the layer of conductive material. Static electricity in any object placed on the floor is grounded by contact through the studs.

U.S. Pat. No. 2,457,299 issued Dec. 28, 1948 to Lancaster et al, deals with a variation of the static electricity discharge flooring system previously discussed. In this structure, however, a non-conductive flooring backing member is provided overlaid with a strip of electrically conductive plastic, the latter being connected to a current conducting grid. In use, there will always be a slow bleed of any charge on the floor through the backing and atmosphere to ground.

U.S. Pat. No. 3,121,825 issued on Feb. 18, 1964 to Abegg et al, also discloses an electrically conductive floor covering, but specifically for use in explosive hazard areas. This system contemplates a composite floor surface material comprising a powdered electrically conductive material suspended in a plastic material. Again, this floor system is designed to prevent the accumulation of static electricity.

U.S. Pat. No. 4,484,250 issued on Nov. 20, 1984 to Rzepecki et al discloses a static displacement mat of composite layered construction. The top layer of vinyl having a high volume resistivity, the sandwich is a middle layer of low surface resistance on to a conductive vinyl backing. The top layer is "tacky" to collect dust particles from the air.

Finally, U.S. Pat. No. 1,940,491 issued Dec. 19, 1933 to Freitag, is the most relevant in respect to the subject application. This patent discloses a protective device incorporated in footwear and which includes means for establishing a detachable flexible low resistance conducting connection between a ground connector and the footwear. The feet of the person being maintained at all times at the potential of the ground conductors.

None of these referenced patents, however, contemplate the provision of a zone of equi-potential, where an operator or worker may have free unrestricted access.

SUMMARY OF THE INVENTION

Accordingly, in its preferred form, the invention comprises a portable grounding mat comprising a flexible base having at least two conductive elements attached to a surface of the base. At least one of the elements forming a continuous grid pattern on the surface of the base, substantially covering the entire surface of the base. A preferred material for the base is a vinyl/polyester fabric and the element is manufactured from high ampacity tinned copper braid.

BRIEF DESCRIPTION OF THE DRAWINGS

The invention will now be described by way of example only, reference being had to the accompanying drawings in which.

DESCRIPTION OF THE PREFERRED EMBODIMENTS

Figure 1:
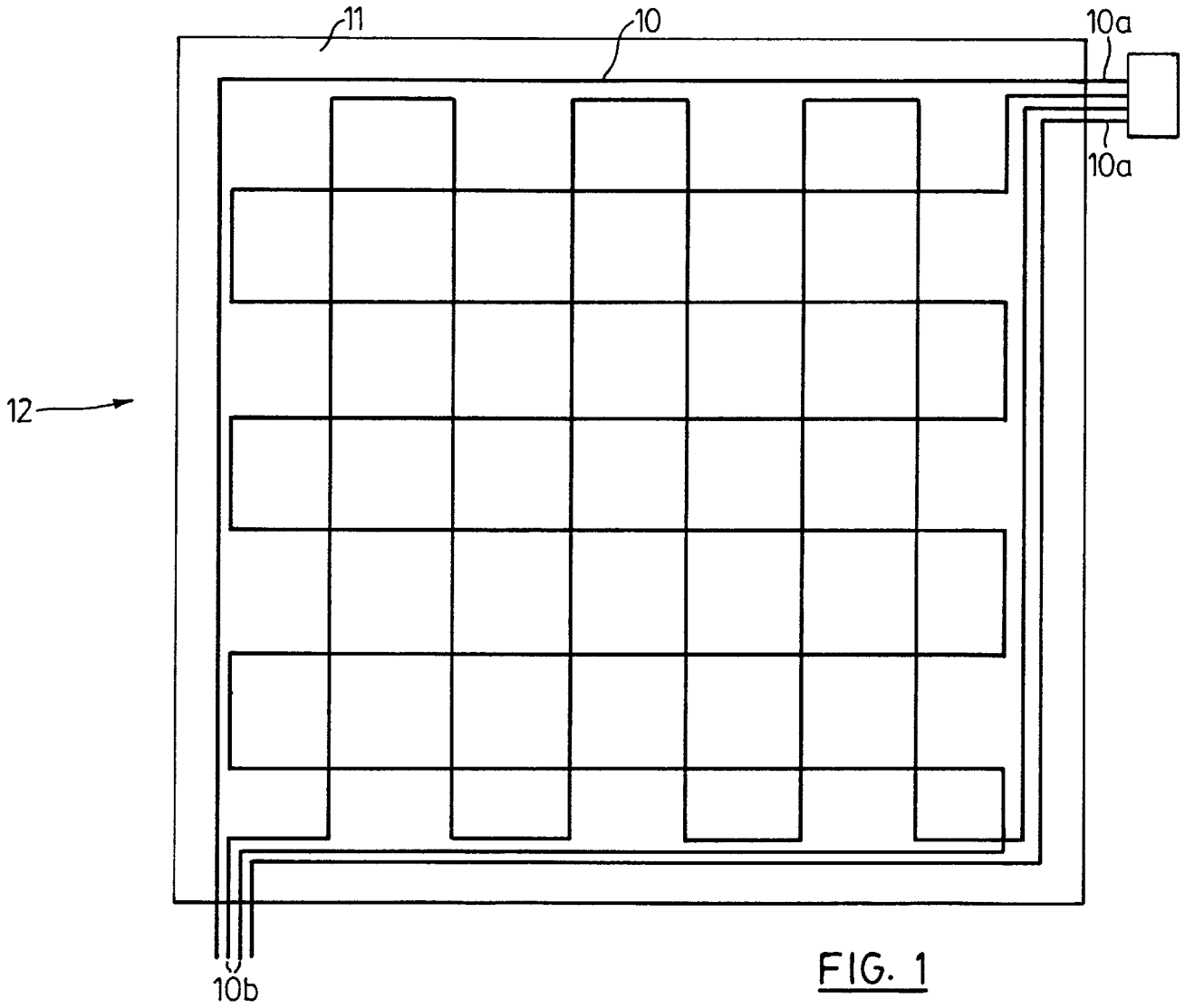
FIG. 1 is a plan view of a typical mat constructed in accordance with the invention.

Looking firstly at the mat design and construction according to FIG. 1, the arrangement is simplicity itself. High ampacity tinned copper braid 10 is attached, for example, by sewing to the fabric 11, which fabric is preferably a vinyl/polyester fabric, to form a composite mat 12. In this embodiment, four continuous braids 10 are shown, two indicated as 10A, being provided around and adjacent the periphery of the mat, and the remaining two 10B are provided in a cross-over grid pattern to cover the central area of the mat.

All braids 10 are connected to the same power source (not shown) thus ensuring that the entire mat is of one potential.

While it is possible to utilize only one continuous copper braid 10, this would not provide the safety factor that is required, since if a physical break were experienced in the cable 10, the mat would cease to be functional.

By utilizing two or more continuous braids 10, in an overlapping fashion, any break in one circuit would not affect the other circuits, which by virtue of the grid design would still provide a full zone of equi-potential.

Figure 2:
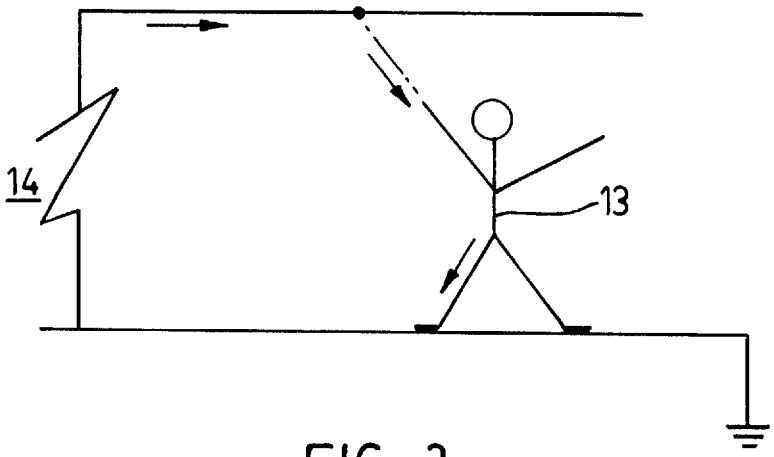
FIG. 2 is a schematic representation of a situation where a worker is subjected to current flow, without the availability of the mat according to the present invention.
Figure 3:
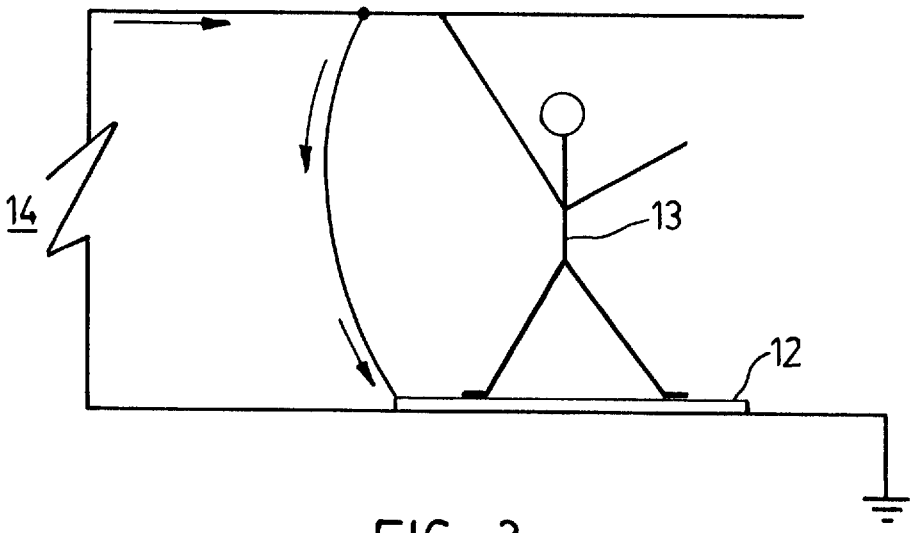
FIG. 3 is a similar schematic representation to that shown in FIG. 2, of the same situation where the mat of the present invention is utilized.

Referring now to FIGS. 2 and 3, these are introduced to further emphasize the significance of utilizing the mat according to the invention.

In FIG. 2, the worker 13 stands directly on the ground and in effect completes the circuit. Current flow from the source 14 flowing directly through the worker to ground. A potentially fatal situation. In FIG. 3, however, the worker 13 is standing on the grounding mat 12 according to the invention, which is connected, in circuit with the power source 14. The current flow is therefore through the mat, notwithstanding the fact that the body of the worker is at full potential.

In this situation, however, the worker is safe from harm.

Obviously, it will be appreciated that there is no size limitations to the inventive mat, since if larger areas have to be covered, a number of separate mats can be joined together.

The grid pattern selected is of design choice only, and depends on the size and number of cables or braids utilized. It is, however, preferable that two or more circuits be utilized to prevent complete circuit breakdown.

As to the size or diameter of the cables or braids 10, obviously larger cables would be safer since they would be more difficult to damage. However, too large a diameter or size of cable would increase the weight, and hence the cost of the system.

The above description is intended in an illustrative rather than a restrictive sense and variations to the specific configurations described may be apparent to skilled persons in adapting the present invention to specific applications. Such variations are intended to form part of the present invention insofar as they are within the spirit and scope of the claims below. For instance, good results have also been achieved using a mat material of neoprene/polyester fabric or waterproofed cotton canvas. In fact, the neoprene/polyester may be preferable to the vinyl/polyester since it is less slippery in wet weather conditions. Nylon, on the other hand, is not preferred since it may be too flammable for present purposes.

We claim:

1. A portable grounding mat to protect a worker working on a power source, said mat comprising a base of flexible material having at least two continuous conductive elements attached to a surface of said base, at least one of said elements following a grid pattern substantially covering the entire surface of said base, said elements being in electrical communication with said power source to provide a zone of equi-potential to said worker on sad base.

2. The mat of claim 1 wherein said flexible base is manufactured from a material selected from the group of materials comprising neoprene/polyester, vinyl/polyester and waterproofed cotton canvas fabric.

3. The mat of claim 2 wherein each of said elements is a high ampacity tinned copper braid.

4. The mat of claim 3 wherein each element is attached to a top surface of said base.

5. The mat of claim 4 wherein four elements are utilized, two said elements providing separate continuous peripheral circuits, and two said elements providing a central interconnected continuous grid pattern.

6. The mat of claim 2 wherein four elements are utilized, two said elements providing separate continuous peripheral circuits, and two said elements providing a central interconnected continuous grid pattern.

7. The mat of claim 3 wherein four elements are utilized, two said elements providing separate continuous peripheral circuits, and two said elements providing a central interconnected continuous grid pattern.

8. The mat of claim 1 wherein each of said elements is a high ampacity tinned copper braid.

9. The mat of claim 8 wherein four elements are utilized, two said elements providing separate continuous peripheral circuits, and two said elements providing a central interconnected continuous grid pattern.

10. The mat of claim 1 wherein each element is attached to a top surface of said base.

11. The mat of claim 10 wherein four elements are utilized, two said elements providing separate continuous peripheral circuits, and two said elements providing a central interconnected continuous grid pattern.

12. The mat of claim 1 wherein four elements are utilized, two said elements providing separate continuous peripheral circuits, and two said elements providing a central interconnected continuous grid pattern.

* * * * *